US005413421A

United States Patent [19]

Okamoto

[11] Patent Number: 5,413,421

[45] Date of Patent: May 9, 1995

[54] PRINTING HEAD DEVICE

[75] Inventor: Masaya Okamoto, Tokyo, Japan

[73] Assignee: NEC Corporations, Tokyo, Japan

[21] Appl. No.: 216,024

[22] Filed: Mar. 21, 1994

[30] Foreign Application Priority Data

Mar. 22, 1993 [JP] Japan ..... 5-086742

[51] Int. Cl.[6] ..... B41J 2/27

[52] U.S. Cl. ..... 400/124.15; 400/124.14; 400/124.16; 101/93.29

[58] Field of Search ..... 400/124, 124.15, 124.14, 400/124.11, 124.16; 101/93.29, 93.30, 93.31, 93.33, 93.34, 93.09, 93.32

[56] References Cited

U.S. PATENT DOCUMENTS

| | | | |
|---|---|---|---|
| 2,850,908 | 9/1958 | Foster | 400/124.15 |
| 2,916,920 | 12/1959 | Planner et al. | 400/124.15 |
| 3,715,020 | 2/1973 | Nordin | 400/124.15 |
| 4,022,311 | 5/1977 | Krull | 101/93.34 |

FOREIGN PATENT DOCUMENTS

| | | | |
|---|---|---|---|
| 2716617 | 10/1978 | Germany | 400/124.15 |
| 52-006420 | 1/1977 | Japan | 400/124.15 |

OTHER PUBLICATIONS

IBM Technical Disclosure Bulletin, "Printhed for Wire Matrix Printer", T. Kanno, vol. 26, No. 6, p. 2790, Nov. 1983.

*Primary Examiner*—David A. Wiecking
*Attorney, Agent, or Firm*—Foley & Lardner

[57] ABSTRACT

A printing head device according to the present invention includes a plurality of printing pins corresponding to respective dots, a plurality of first pin drive plates having the printing pins fixed thereon and having surfaces on which first electrodes are formed, a plurality of second pin drive plates having second electrodes opposing to the first electrodes with predetermined gaps therebetween, a first drive plate support member for supporting the first pin drive plates through elastic members, respectively, and a second drive plate support member for supporting the second pin drive plates. Further, the second drive plate support member is vibrated repeatedly in a direction toward a top end of the printing pin by a drive unit. A drive circuit applies a voltage based on a printing signal between the first and second electrodes of the first and second pin drive plates with the vibration timing of the drive unit to generate Coulomb force between the first and second electrodes. With this construction, it is possible to enable the printing pins to perform a print by a single drive unit and to miniaturize the printing head.

13 Claims, 9 Drawing Sheets

PRINTING HEAD DEVICE

BACKGROUND OF THE INVENTION

1. Field of the Invention

The present invention relates to a printing head device of a dot-impact type printer and, particularly, to a printing head capable of being miniaturized.

2. Description of the Related Art

In a conventional dot-impact type printer, a printing head having a plurality of printing wires and a drive mechanism for driving the printing wires is put in a facing relation to a recording sheet through, for example, an ink ribbon and prints a dot pattern of such as characters on the recording sheet by selectively driving the printing wires while the head is running. FIG. 12 is a cross section of a typical conventional printing head and FIG. 13 is a plan view thereof showing an arrangement of printing elements fixed in the printing head. The printing head shown in FIG. 12 includes the printing elements 80 shown in FIG. 14 in a printing head housing 81 and arranged in an annular region as shown in FIG. 13. Each printing element 80 includes a printing wire 82, a leaf spring 83 for driving the printing wire, an armature 84, a drive coil 85, a core 86 and a yoke 87. The printing wire 82 is fixedly secured to a top end of the leaf spring 83 and has a top end which can protrude through a guide 88 provided in a top end of the printing head. The armature 84 is fixedly secured to the leaf spring 83 which, in turn, is fixedly secured in between the printing head housing 81 and the core 86. The drive coil 85 is wound on the core 86 and can be selectively driven according to a dot print signal.

When magnetic flux generated by a current flowing through the coil 85 passes through a magnetic circuit constituted with the armature 84, the core 86 and the yoke 87, the armature 84 is attracted to the core 86. Therefore, the top end of the printing wire 82 collides with the ink ribbon and the recording sheet (which are not shown) to print the latter.

In such conventional printing head, however, the magnetic circuit must be provided every printing wire, causing a miniaturization of the printing head to be very difficult.

SUMMARY OF THE INVENTION

An object of the present invention is to provide a printing head in which the number of magnetic circuits can be substantially reduced, allowing a miniaturization thereof.

A printing head device according to the present invention comprises a plurality of printing pins corresponding to dots, a plurality of first pin drive plates which have the printing pins and have a surface on which a first electrode is formed, respectively, a plurality of second pin drive plates having a second electrode which faces to the first electrode respectively, a first drive plate support member for movably supporting the respective first pin drive plates, and a second drive plate support member for supporting the plurality of the second pin drive plates. The second drive plate support member vibrates repeatedly in a direction toward top end of the printing pin by means of a drive unit. A drive circuit applies a voltage which corresponds to a print signal between the first and second electrodes of the first and second pin drive plates with a timing of vibration of the drive unit to produce Coulomb force between the first and second electrodes. As a result, the first pin drive plate having the printing pin is attracted by the second pin drive plate according to the printing signal and moved together with the drive unit in the direction toward the top end of the printing pin.

Since, according to this construction, it is possible to print by using one drive unit for a plurality of printing pins and the first and second pin drive plates themselves are not bulky, thereby a miniaturization of the printing head becomes possible.

When the first drive plate support member is provided with an elastic member for movably supporting each of the first pin drive plates in which the printing pins are fixed, and the elastic member is of an electrically conductive material, it is possible to electrically connect the first electrode of the first pin drive plate to the drive circuit through the elastic member. Therefore, the elastic member functions not only to support the first pin drive plate but also to electrically connect the electrode to the drive circuit, resulting in an improved wiring efficiency.

BRIEF DESCRIPTION OF THE DRAWINGS

The above and other objects, features and advantages of the present invention will become more apparent from the following detailed description taken with the accompanying drawings in which.

DETAILED DESCRIPTION OF THE PREFERRED EMBODIMENTS

Figure 1:
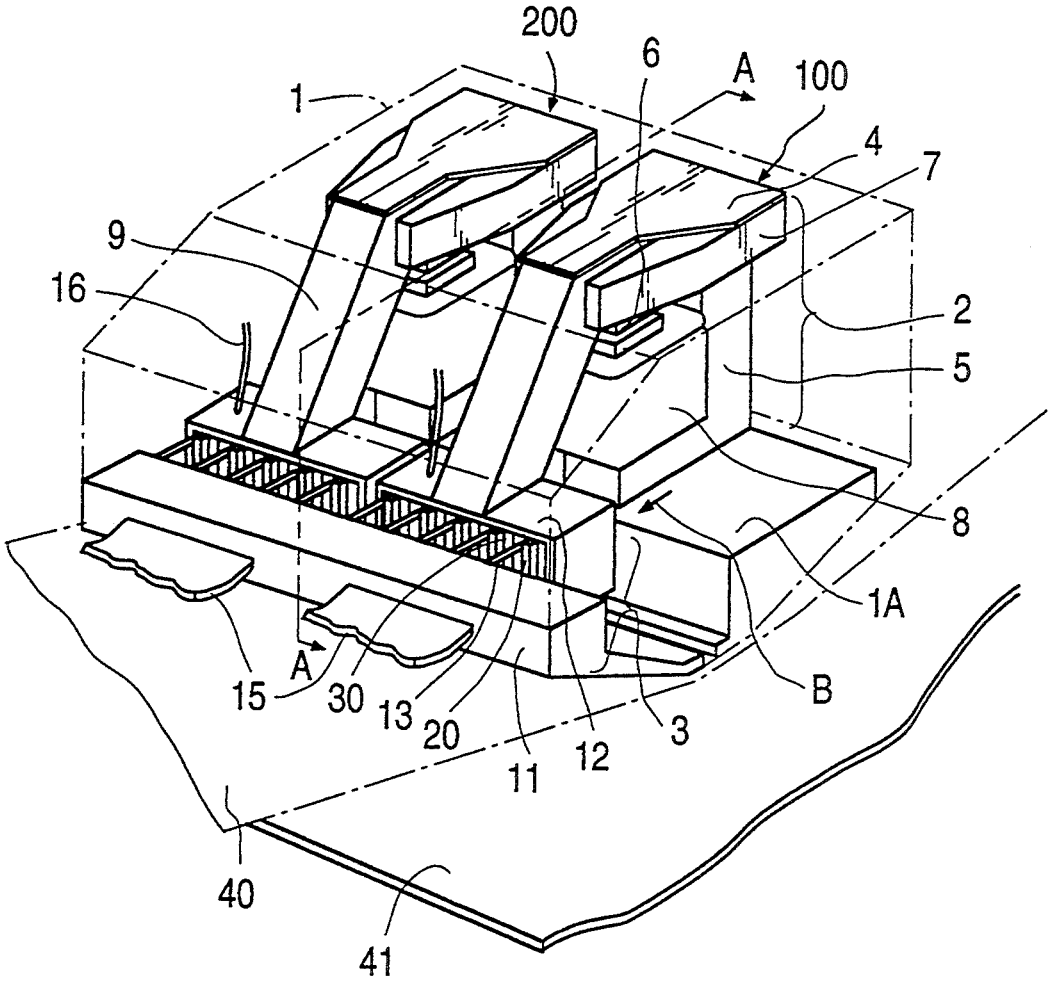
FIG. 1 is a perspective view of a printing head according to an embodiment of the present invention, with a housing being shown by chain lines.
Figure 2:
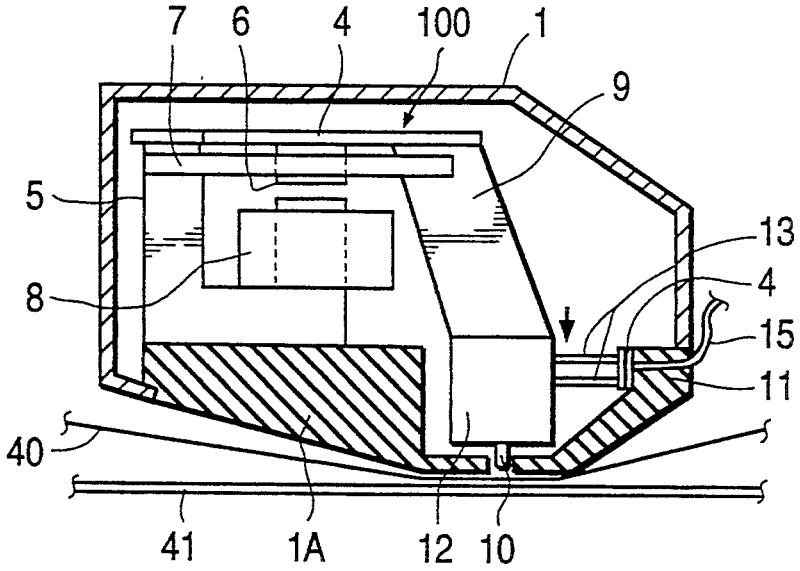
FIG. 2 is a cross section of the printing head taken along a line A—A in FIG. 1.

FIG. 1 is a perspective view of a printing head according to an embodiment of the present invention, with a housing being shown by chain lines and FIG. 2 is a cross section of the printing head taken along a line A—A in FIG. 1. In these figures, the printing head of this embodiment is a printing head device of a dot-impact type printer in which a dot pattern of such as character is printed on a recording sheet 41 through an ink ribbon 40 according to a printing signal. Printing drive mechanisms 100 and 200 having identical constructions are fixedly arranged in parallel in a printing head housing 1 of aluminum. The printing drive mechanism 100 (and 200) is constructed with a magnetic drive unit 2 having a single magnetic circuit for generating vibration and a pin drive unit 3 which is vibrated as a whole in a direction toward a top end of a printing pin 10 (which is vertical to the recording sheet 41 as shown in FIG. 2) by the vibration transmitted from the magnetic drive unit 2.

The magnetic drive unit 2 includes an arm 9 having a top end to which the pin drive unit 3 is fixed, a leaf spring 4 for supporting one end of the arm 9, a core 5 on which the leaf spring 4 is fixed, an armature fixed to a center portion of one surface of the leaf spring 4 and facing to the other end of the core 5 with a gap, a yoke 7 and a drive coil 8. The core 5 is fixed to a base 1A which, in turn, is fixed to the printing head housing 1. The yoke 7 has legs forming a U-shape and has one end fixed to the core 5. Thus, the core 5, the armature 6 and the yoke 7 are magnetically coupled. The core 5, the armature 6 and the yoke 7 are of magnetic material. The armature 6 is arranged in a position between the legs of the U-shaped yoke 7 and is not fixed to the yoke 7. A distance between the leaf spring 4 and the yoke 7 is larger than a moving stroke of the printing pin 10 so that the leaf spring 4 does not contact with the yoke 7 during printing. The drive coil 8 is wound on and fixed to the core 5 in the vicinity of the armature, so that the armature 6 is attracted magnetically to the end portion of the core 5 by current flowing through the drive coil. When the armature 6 is attracted to the core 5, the leaf spring 4 is deformed so as to move the arm 9 toward the recording sheet 41. By ON/OFF switching current flowing through the drive coil 8, the pin drive unit 3 fixed to the arm 9 vibrates in a direction toward the top end of the printing pin 10.

The pin drive unit 3 selectively drives a plurality of printing pins 10 arranged in a row for a dot printing at the time of the movement of the arm 9. Each pin 10 is driven on the basis of the printing signal supplied to the pin drive unit 3 in concomitance with the movement of the arm 9. The pin drive unit 3 includes first pin drive plates 20 on which the plurality of the pins 10 are fixed individually, a first drive plate support member 11 of insulating material for supporting the first pin drive plates 20 through respective electrically conductive, elastic members 13, second pin drive plates 30 facing the respective first pin drive plates 20 with a predetermined gap, and a second drive plate support member 12 of metal material which fixes the second pin drive plates 30. The first drive plate support member 11 is fixed in the printing head housing 1 and the second drive plate support member 12 is fixed to the arm 9.

Figure 3:
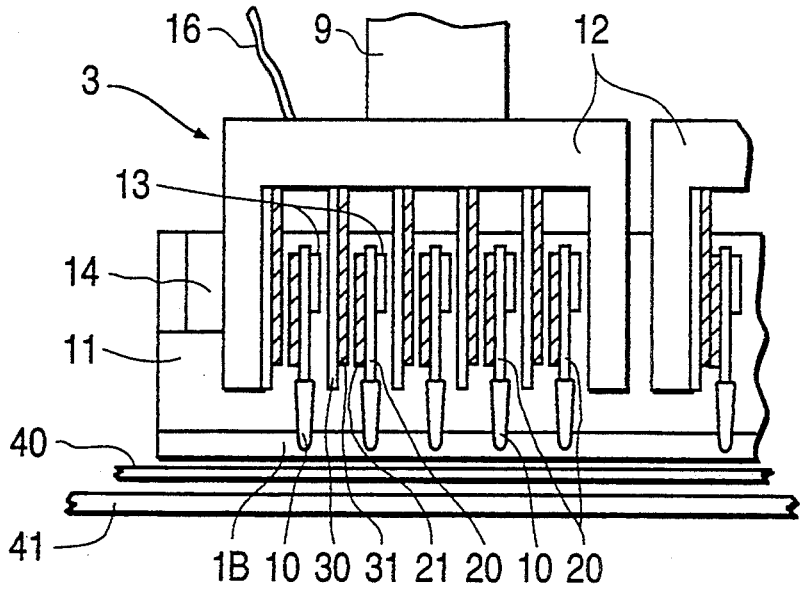
FIG. 3 is a plan view of a pin drive unit and a peripheral elements thereof in a state of before printing when looked in a direction B in FIG. 1.
Figure 7:
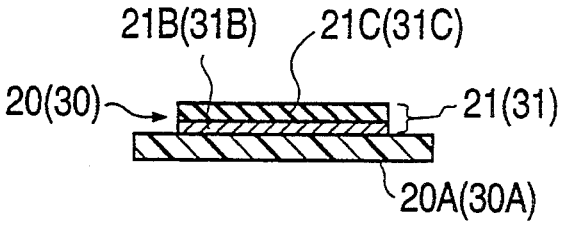
FIG. 7 is a cross section of the first and second pin drive plates of the printing head shown in FIG. 1.

FIG. 3 is a front view of the pin drive unit 3 and a peripheral elements thereof in a state of before printing when looked in a direction B in FIG. 1. In FIG. 3, each of the first pin drive plates 20 on which the pins 10 are fixed, is arranged alternatively of the second pin drive plate 30 fixed to the second drive plate support member 12 with a predetermined gap. The first and second pin drive plates 20 and 30 have on one surfaces thereof electrode films 21 and 31, respectively, which are facing to each other. As shown in FIG. 7, the first and second pin drive plates 20 and 30 are formed by forming the electrode films 21 and 31 on ceramics plates 20A and 30A each being 1 mm thick or lesser, respectively, as the first and second electrodes. The electrode films 21 and 31 are formed by electrically conductive films 21B and 31B and insulating films 21C and 31C formed thereon, respectively. The conductive films 21B and 31B generate Coulomb force by a voltage applied thereto, with which they are attracted by each other. The insulating films 21C and 31C are provided in order to prevent the electrode films 21 and 31 from being short-circuited when they are in contact by Coulomb force. Either one of the insulating films 21C and 31C may be omitted.

Figure 5:
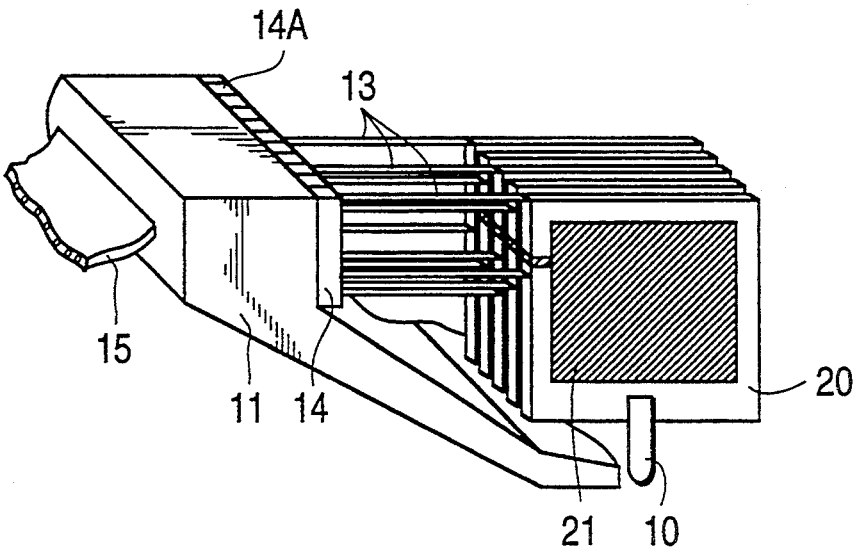
FIG. 5 is a perspective view of the printing head showing a connection between a first drive plate support member and a first pin drive plate of the printing head shown in FIG. 1.
Figure 6:
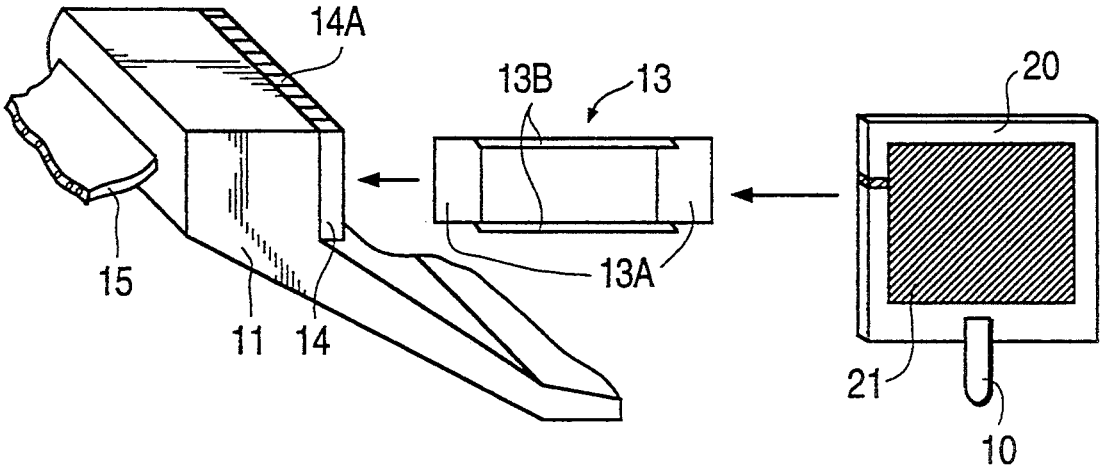
FIG. 6 is a perspective view of the first drive plate support member and the first pin drive plate shown in FIG. 5 in an disassembled state.

Each of the first pin drive plate 20 is movably fixed to the first drive plate support member 11 by an elastic member 13 as shown in FIG. 5. The first drive plate support member 11 has a connector 14 which fixes the elastic member 13 and is connected to a cable 15 electrically. As shown in FIG. 6, a pair of thin plates 13A of the elastic member 13 are connected to each other by a pair of spring members 13B. One of the thin plates 13A is inserted into a gap 14A provided in the connector 14 and fixed therein and the other thin plate 13A is fixed to the other surface of the first pin drive plate 20, on which there the electrode film 21 is formed. The conductive film 21B (FIG. 7) of the electrode film 21 is electrically connected to the conductive elastic member 13, so that the conductive film is electrically connected to the cable 15.

Therefore, each of the elastic member 13 supports the first pin drive plate 20 and has functions to move the printing pins 10 horizontally and vertically with respect to the recording sheet 41 and to electrically connect the electrode film 21 to the cable 15.

In FIG. 3, each of the second pin drive plates 30 opposing to the first pin drive plates 20 is fixed, together with the electrode film 31, to the second drive plate support member 12 made of metal and grounded through a cable 16 connected to the second drive plate support member 12.

When a drive (printing) signal is supplied through the cables 15 and 16, voltages are applied between the electrode films 21 and 31 selectively according to the printing signal and the first and second pin drive plates 20 and 30 are attracted by each other. That is, the first pin drive plate 20 having the printing pins 10 fixed thereon is attracted by the second pin drive plate 30 by deformation of the elastic member 13. In this case, Coulomb force F is represented by the following equation:

$$F=V^2.\epsilon\,.\,S/2\,.\,d^2 \qquad (1)$$

where V is a voltage between the electrode films 21 and 31, d is a distance between these electrode films, S is an area of each of the conductive films 21B and 31B of the electrode films 21 and 31 and e is permittivity.

Figure 4:
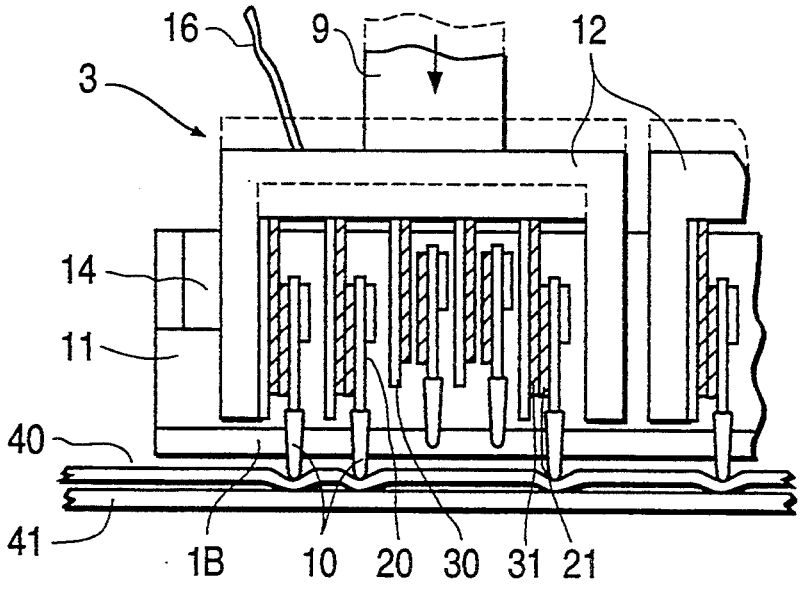
FIG. 4 is a plan view of a pin drive unit and a peripheral elements thereof in a state of printing when looked in the direction B.

The arm 9 is moved in the direction toward the top end of the printing pin 10 by a current supplied to the drive coil 8, when the printing signal is supplied to the electrode films 21 and 31. Therefore, when the printing signal has a voltage V so that the first pin drive plate 20 is held attracted to the second pin drive plate 30, the first pin drive plate 20 and 30 move together with the arm 9 as shown in FIG. 4. At this time, the pin 10 protrudes from a bottom plate 1B of the printing head housing 1. However, when no voltage is supplied to the electrode film 21, the first pin drive plate 20 does not lower with the arm 9 and is kept at a position before printing, that is, the pin does not protrude from the bottom plate 1B. Therefore, only the pin protruded from the bottom plate 1B pushes the ink ribbon 40 to transfer ink to the recording sheet 41. In this embodiment, the magnetic drive unit 2 is driven at the timing of the printing signal as mentioned and, since the first and second pin drive plates 20 and 30 of the pin drive unit 3 are selectively and simultaneously driven according to the printing signal, the pins 10 transfer ink to the recording sheet 41 according to the printing signal.

Coulomb force F depends upon pressure force of the pin 10 to the ink ribbon 40. For example, the pin 10 presses the ink ribbon with a force of 10 grams, the voltage V, the area S and the distance d may be made about 100 V, about 1–2 mm and about 0.1 mm, respectively.

When the printing pin 10 reciprocates vertically of the recording sheet 41, it is preferable in order to prevent lateral deviation of the pin that the reciprocation of the pin 10 is guided by a small guide hole.

In the printing head of this embodiment, there is no need of providing a drive coil, a core and an armature every pin 10 and only one or two magnetic drive units are enough. Further, since the pin drive unit 3 can be miniaturized, it is possible to substantially reduce a size of the printing head compared with the conventional head.

Figure 8:
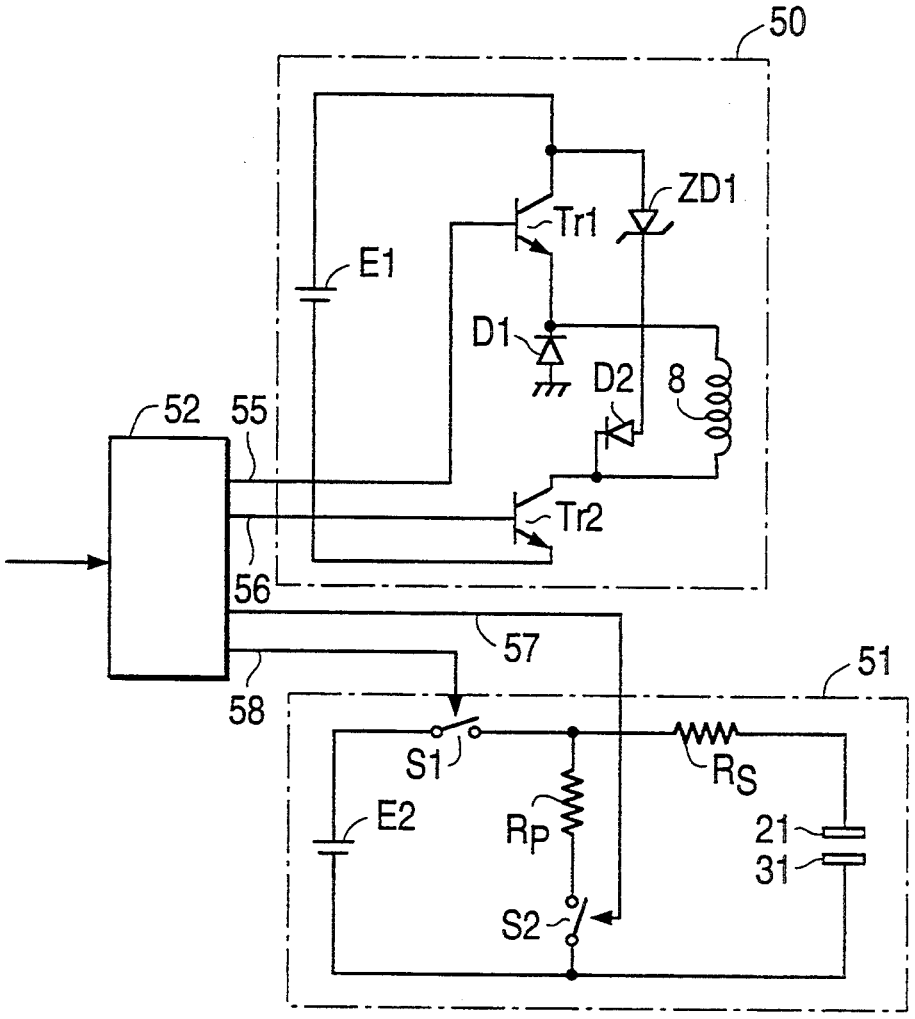
FIG. 8 is a circuit diagram of a drive circuit of the printing head shown in FIG. 1.
Figure 9:
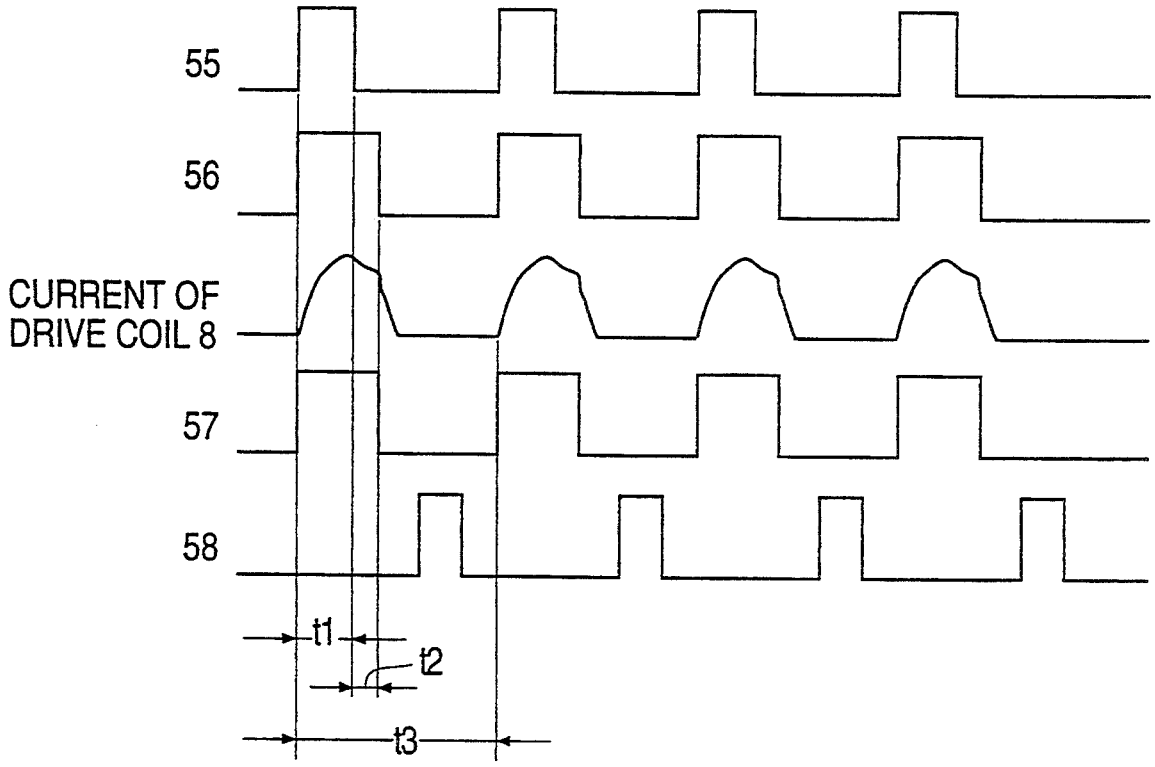
FIG. 9 is a timing chart showing an operation of the drive circuit shown in FIG. 8.

Now, a drive circuit of the printing head shown in FIGS. 1 and 2 will be described. FIG. 8 is a circuit diagram of a drive circuit of the printing head and FIG. 9 is a timing chart showing an operation of the drive circuit of the printing head. In these figures, a printing head drive circuit includes a drive coil driving circuit 50 for driving the drive coil 8, a pin drive plate driving circuit 51 for driving the first and second pin drive plates 20 and 30 and a drive control circuit 52. The printing head drive circuit is mounted on a electrical circuit board of the printer. The drive control circuit 52 produces control signals 55, 56, 57 and 58 shown in FIG. 9 based on the printing signal. The control signals 55 and 56 are repeatedly produced in synchronous with a printing period and supplied to base terminals of transistors Tr1 and Tr2 of the drive coil driving circuit 50. The transistors Tr1 and Tr2 are turned on simultaneously with leading edges of the control signals 55 and 56, respectively. The transistor Tr1 is turned off after a time t1 lapses and the transistor Tr2 is turned off after a time t2 lapses from t1. When the transistors Tr1 and Tr2 are in on-states for the time t1, current flows from a power source E1 through the transistor Tr1, the drive coil 8 and the transistor Tr2, and thereby the armature 6 (FIGS. 1 and 2) is attracted by the core 5, lowering the arm 9. For a time from a time at which the transistor Tr1 is turned off to a time at which the transistor Tr2 is turned off, that is, the time t2, the power source E1 is blocked by the transistor Tr1. However, energy stored in the drive coil 8 flows through the drive coil 8, the transistor Tr2 and ground to a diode D1. Therefore, the lowered position of the arm 9 is maintained until the transistor Tr2 is turned off. The time t2 is necessary to stabilize an operation of the magnetic circuit by approximating a current waveform of the drive coil to a rectangular waveform. The drive coil 8 is driven every constant time t3 which is equal to a printing period.

On the other hand, the control signals 57 and 58 are used to exchange on/off-states of switches S1 and S2 of the pin drive plate driving circuit 51. Although a single pin drive plate driving circuit 51 is shown in FIG. 8, a corresponding number of the pin drive plate driving circuits 51 to the number of the pins 10 are connected in parallel to each other to a power source E2. The control signals 57 and 58 are pulse signal trains which become high or low levels every constant time t3 based on the printing signal and the respective pins 10 are selectively driven by these signals. One of terminals of the switch S1 is connected to the power source E2 and the other terminal thereof is connected to the electrode film 21 of the first pin drive plate 20 through a resistor Rs. The electrode film 31 of the second pin drive plate 30 and the switch S2 are connected to a ground terminal of the power source E2, the switch S2, resistors Rp and Rs and the electrode films 21 and 31 forming a closed circuit. The cable 15 shown in FIGS. 1 and 2 connects the resistor Rs to the electrode film 21 and the cable 16 connects the electrode film 31 to the ground terminal of the power source E2.

As shown in FIG. 9, the control signals 57 and 55 are synchronized while the control signals 58 and 57 are not. Therefore, only the switch S1 is closed during a time in which current flows through the drive coil 8 to apply a voltage between the electrode films 21 and 31 and make them attracted by each other by Coulomb force to thereby perform a printing operation as shown in FIG. 4. In this case, the switch S1 is not closed when the printing signal has no voltage.

On the other hand, when the switch S1 is turned off and the switch S2 is turned on, charge stored between the electrode films 21 and 31 is discharged through the resistors Rs and Rp. In this manner, the on/off operation of the switches S1 and S2 are performed in synchronous with the operation of the drive coil 8.

In the embodiment described above, the printing signal voltage is applied to the electrode film 21 through the elastic member 13 and the electrode film 31 is grounded through the second drive plate support member 12. However, the application of voltage and the grounding may be reversed. In such case, the second drive plate support member 12 may be made of an insulating material, the respective electrode films 31 may be connected to the resistor Rs of the pin drive plate driving circuit 51 and the respective electrode films 21 may be grounded at the ground terminal of the power source E1 through the elastic members 13.

Figure 10:
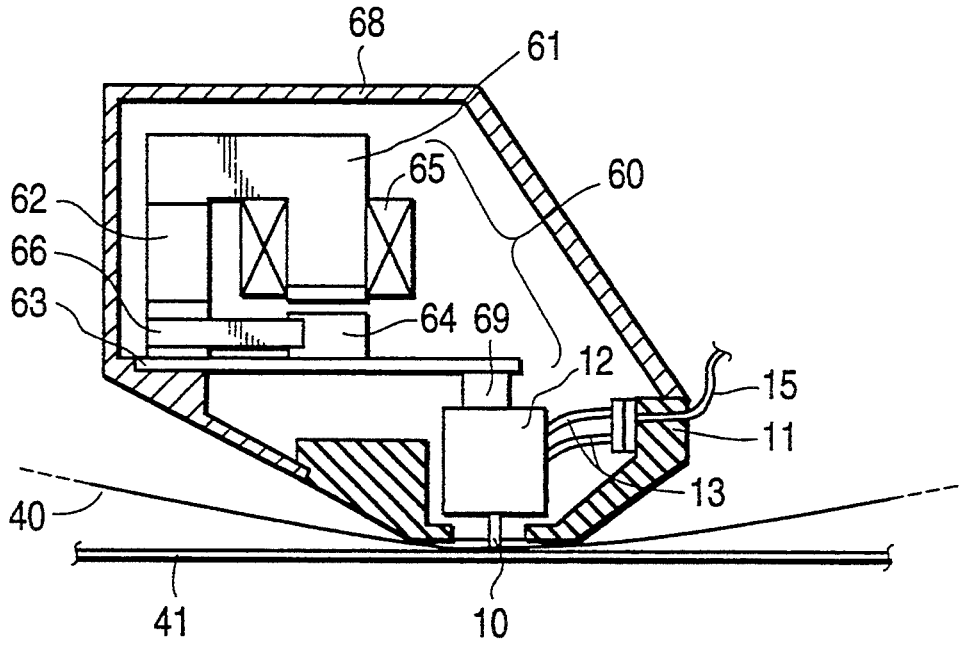
FIG. 10 is a cross section of a printing head according to a second embodiment of the present invention.

FIG. 10 is a cross section of a printing head according to a second embodiment of the present invention. This embodiment differs from the previously mentioned embodiment in the structure of a magnetic drive unit 60. A permanent magnet 62 is fixed in series with a core 61 of the magnetic drive unit 60 and a leaf spring 63 is fixed below the core 61. The leaf spring 63 and the core 61 are fixed to a printing head housing 68. An armature 64 is fixed on the leaf spring 63 and a gap is formed between the core 61 and the armature 64. The core 61, the permanent magnet 62, a yoke 66 and the armature 64 constitute a magnetic circuit. The armature 64 is always attracted to the core 61 by the permanent magnet 62 and thus an arm 69 fixed to a top end of the leaf spring 63 is shifted to an opposite side of a recording sheet 41. The drive coil 65 is wound on the core 61 such that, in response to the drive signal supplied thereto, magnetic force is generated in a direction in which magnetic force of the permanent magnet 62 is cancelled out.

When there is no current in the drive coil 65, the leaf spring 63 deforms oppositely of the printing pin 10 to put the pin 10 remote from the recording sheet 41 at which no printing is performed. However, when a current flows through the drive coil 65 in synchronous with the printing signal, attraction of the armature 64 due to the permanent magnet 62 is released and the second drive plate support member 12 moves toward the recording sheet 41 immediately. When a voltage due to the printing signal is applied to the electrode films 21 and 31 of the first and second pin drive plates 20 and 30 as shown in FIG. 4, simultaneously with this movement, the first and second pin drive plates 20 and 30 are attracted by each other. As a result, the elastic member 13 deforms and the printing pin 10 moves together with the movement of the second drive plate support member 12, printing the recording sheet 41 through the ink ribbon 40. A drive circuit used may be the same as that shown in FIG. 9.

According to this embodiment, it is possible to reduce the length of the arm fixed to the leaf spring, compared with the previous embodiment and, so, it is possible to stabilize the movement of the arm.

Figure 11:
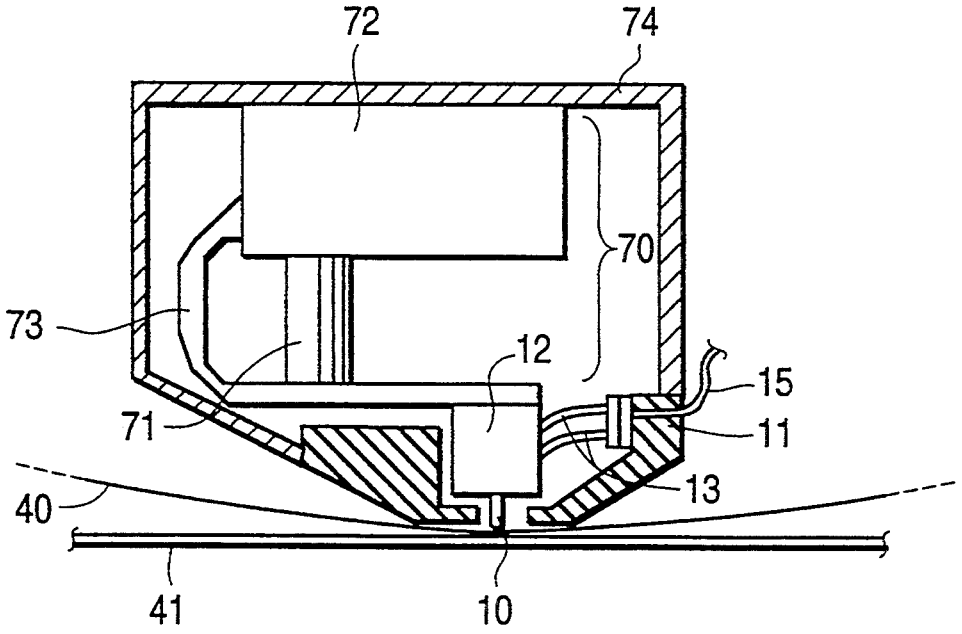
FIG. 11 is a cross section of a printing head according to a third embodiment of the present invention.
Figure 12:
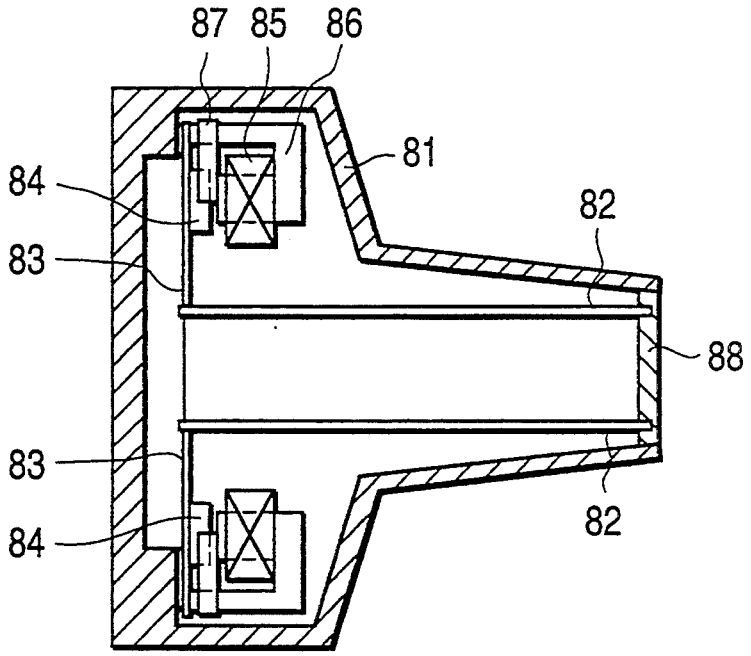
FIG. 12 PRIOR ART
FIG. 12 is a cross section of a conventional printing head.
Figure 13:
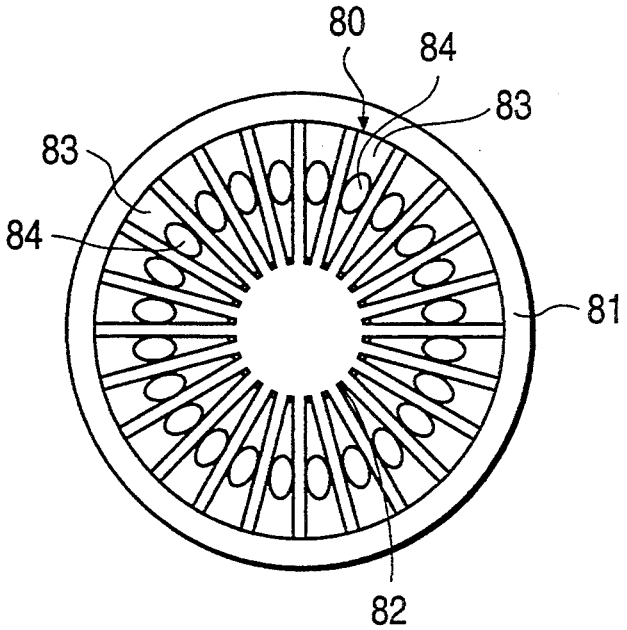
FIG. 13 PRIOR ART
FIG. 13 is a plan view showing an arrangement of a plurality of printing elements of the conventional printing head shown in FIG. 12.
Figure 14:
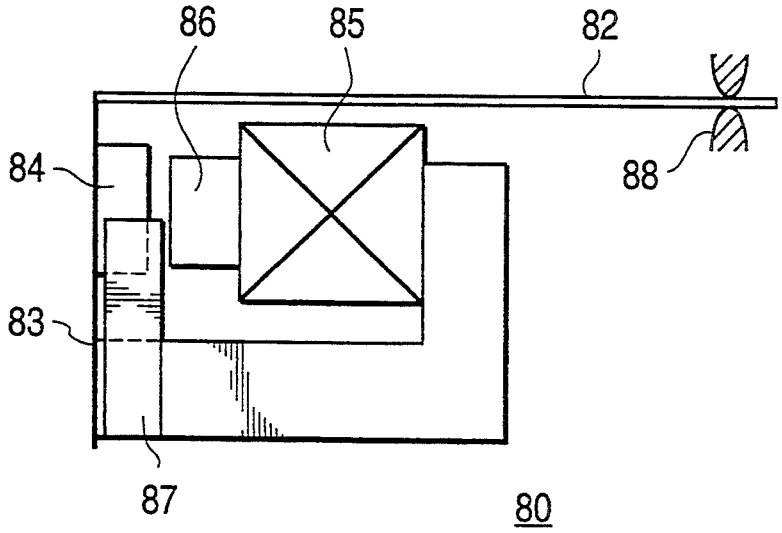
FIG. 14 PRIOR ART
FIG. 14 is a front view of a printing element of the conventional printing head shown in FIG. 12.

FIG. 11 is a cross section of a printing head according to a third embodiment of the present invention. Although the magnetic drive units are used in the first and second embodiments, a drive unit to used in the third embodiment is a piezoelectric element. In FIG. 11, a drive unit 70 includes a piezoelectric element 71, a support member 72 to which one end of the piezoelectric element 70 is fixed and a vibration amplifying member 73 to which the other end of the piezoelectric element 71 is fixed and on a point of action of which a second drive plate support member 12 is fixed to amplify deformation of the piezoelectric element 71. One end of the vibration amplifying member 73 is fixed to the support member 72. The support member 72 is fixed to a printing head housing 74. Since construction of other portion than the drive unit 70 is the same as that of the first embodiment, details thereof are omitted.

Before a drive signal is applied to the piezoelectric element 71, the printing pin 10 is separated from the recording sheet 41 and does not print at all. When the drive signal is supplied in synchronous with the printing signal, the piezoelectric element 71 is expanded and the second drive plate support member 12 moves immediately toward the recording sheet 41. When a voltage due to the printing signal is applied to the electrode films 21 and 31 of the first and second pin drive plates 20 and 30 simultaneously with the movement of the second drive plate support member 12 as shown in FIG. 4, the printing pin 10 prints the recording sheet 41 through the ink ribbon 40. In this embodiment, a piezoelectric element drive circuit is used instead of the drive coil driving circuit 50 in FIG. 9 and the piezoelectric element 71 is driven with the same timing as that of the control signal 56.

This embodiment does not require any magnetic circuit and further the vibration amplifying member 73 functions in the same way as the combination of the arm and the leaf spring. Therefore, the number of parts is smaller than that in the first or second embodiment.

The present invention is not limited to the first to third embodiments mentioned above and various modifications are possible within the scope defined by the appended claims. For example, the configuration of the first and second pin drive plates 20 and 30 may be any so long as they are in the form of plate. Further, the printing pin 10 which is described as being fixed to the first pin drive plate 20 may be formed as a portion of the first pin drive plate 20.

What is claimed is:

1. A printing head device of a dot-impact type printer for printing a dot pattern on a recording sheet according to a printing signal, comprising:

a plurality of printing pins corresponding to dots;

a plurality of first pin drive plates having said printing pins fixed thereon and having surfaces on which first electrodes are formed;

a plurality of second pin drive plates having second electrodes opposing to said first electrodes respectively;

a first drive plate support member for movably supporting said first pin drive plates respectively;

a second drive plate support member for supporting said second pin drive plates;

a drive unit for vibrating said second drive plate support member in a direction toward a top end of said printing pins; and a drive circuit for applying a voltage based on a printing signal between said first and second electrodes with a vibration timing of said drive unit to produce Coulomb force between said first and second electrodes.

2. The printing head device claimed in claim 1, wherein said first drive plate support member is provided with an elastic member for movably supporting each of said first pin drive plates.

3. The printing head device claimed in claim 2, wherein said elastic member is of electrically conductive material.

4. The printing head device claimed in claim 3, wherein said first electrode is electrically connected to said drive circuit through said elastic member.

5. The printing head device claimed in claim 4, wherein said first drive plate support member has a connector connected to said drive circuit, and said elastic member is connected to said connector.

6. The printing head device claimed in claim 4, wherein said second electrode is electrically connected to said drive circuit through said second drive plate support member.

7. The printing head device claimed in claim 4, wherein said second electrodes are connected to said drive circuit individually.

8. The printing head device claimed in claim 1, wherein at least one of said first and second electrodes has an insulating layer on its surface.

9. The printing head device claimed in claim 1, wherein said drive unit includes a core, a drive coil wound on said core, an armature arranged with a predetermined gap with respect to said core, an elastic member fixing said armature and a member for coupling said elastic member and said second drive plate support member.

10. The printing head device claimed in claim 9, wherein said drive circuit includes a coil drive circuit for repeatedly supplying current to said drive coil with the same period as that of said printing signal and a pin drive circuit for applying voltage based on said printing signal between said first and second electrodes with the timing of the current supply to produce Coulomb force between said first and second electrodes.

11. The printing head device claimed in claim 1, wherein said drive unit includes a core, a permanent magnet connected in series with said core, a drive coil wound on said core for generating magnetic flux enough to cancel magnetic flux of said permanent magnet, an armature arranged with a predetermined gap with respect to said core, an elastic member fixing said armature and a member for coupling said elastic member and said second drive plate support member.

12. The printing head device claimed in claim 1, wherein said drive unit includes a piezoelectric element and a member fixed to the other end of said piezoelectric element and fixing said second drive plate support member at a point of action to which expansion and contraction of said piezoelectric element.

13. The printing head device claimed in claim 1, further comprising a printing head housing for housing the components thereof other than said drive circuit.

* * * * *